United States Patent [19]

von Holdt

[11] 4,004,448

[45] Jan. 25, 1977

[54] AUTOMATIC DIE SAFETY LOCK FOR A METAL STAMPING DIE

[76] Inventor: John W. von Holdt, 7430 N. Croname Road, Niles, Ill. 60648

[22] Filed: Aug. 14, 1975

[21] Appl. No.: 604,806

[52] U.S. Cl. ..... 72/462; 83/637

[51] Int. Cl.[2] ..... B21J 13/02

[58] Field of Search ..... 72/462, 456, 470; 83/637

[56] References Cited

UNITED STATES PATENTS

| | | | |
|---|---|---|---|
| 2,225,145 | 12/1940 | Baumbach | 72/456 |
| 2,997,969 | 8/1961 | Holmes | 72/456 |

*Primary Examiner*—C.W. Lanham
*Assistant Examiner*—Gene P. Crosby
*Attorney, Agent, or Firm*—Charles F. Pigott, Jr.

[57] ABSTRACT

A locking mechanism is provided for locking the upper and lower portions of a stamping die together when the die is out of press and releasing the upper and lower portions of the stamping die from locking engagement with each other when the stamping die is in press. The mechanism includes an elongated lockbar operatively associated with a spring-biased safety pin and a fixed pivot pin in the upper portion of the stamping die. A vertical leader pin projects upward from the lower portion of the stamping die into a bushing mounted in the upper portion of the stamping die and includes an undercut portion forming a locking surface for cooperative locking and releasing engagement with the lockbar in response to movement of the safety pin which senses whether the stamping die is in press.

12 Claims, 7 Drawing Figures

AUTOMATIC DIE SAFETY LOCK FOR A METAL STAMPING DIE

BACKGROUND OF THE INVENTION

This invention relates to a locking device for a metal stamping die, and more particularly to a locking mechanism for automatically locking the upper and lower portions of a die assembly together when the die assembly is not operatively positioned in a press and which disengages from a locking position when the die assembly is operatively positioned in a press.

While a metal stamping die is very useful for cutting and forming metal, it may be potentially harmful to those working in a metal stamping shop unless it is equipped with a proper safety device. When a metal stamping die is removed from a press by a crane or the like, there exists the risk that the lower and upper portion of the die assembly may be separated and come crashing down on the floor. Once removed from the press, there exists a possibility that an operator may inadvertently get his foot or hand wedged between the sharp edges of upper and lower portions of a forming punch in the stamping die which may result in serious injury or amputation of that limb. Furthermore, there also exists the tendency of the die assembly to become separated and come crashing to the floor when the die assembly is inserted into the press.

SUMMARY OF THE INVENTION

It is therefore one object of this invention to provide an automatic die safety lock for a metal stamping die, that automatically locks the upper and lower portions of a die assembly together when not in press, and which is operative to release the upper and lower portions of the die assembly when in press.

It is another object of this invention to provide an improved lock for a metal stamping die which is dependable in operation, inexpensive to manufacture, readily installed and removed from operating position, of relatively simple design and construction, and capable of performing properly after long periods of use.

A locking mechanism for a metal stamping die is provided for locking the upper and lower die assemblies together when the stamping die is out of press, and releasing the upper and lower die assemblies from locking engagement with each other when the stamping die is in press. An elongated lockbar is positioned in a cavity formed in the upper die assembly and is moveable to an in press position, an intermediate position and an out of press position. A fixed pivot pin is operatively associated with the lockbar and positioned beneath the lockbar. A safety pin for sensing whether the stamping die is in press is slidably positioned in the upper die assembly and has a groove in its lower portion that pivotally cooperates with one end of the lockbar. Spring means bias the safety pin upwards. The lower die assembly carries a vertical elongated leader pin which is slidably positioned in a bushing mounted in the upper die assembly. The leader pin is shaped to provide an undercut portion forming a camming surface for cooperative locking engagement with another end of the locking bar when the stamping die is out of press.

Other objects and advantages of the invention will become more apparent when considering the following description and accompanying drawings.

DESCRIPTION OF PREFERRED EMBODIMENTS

Figure 1:
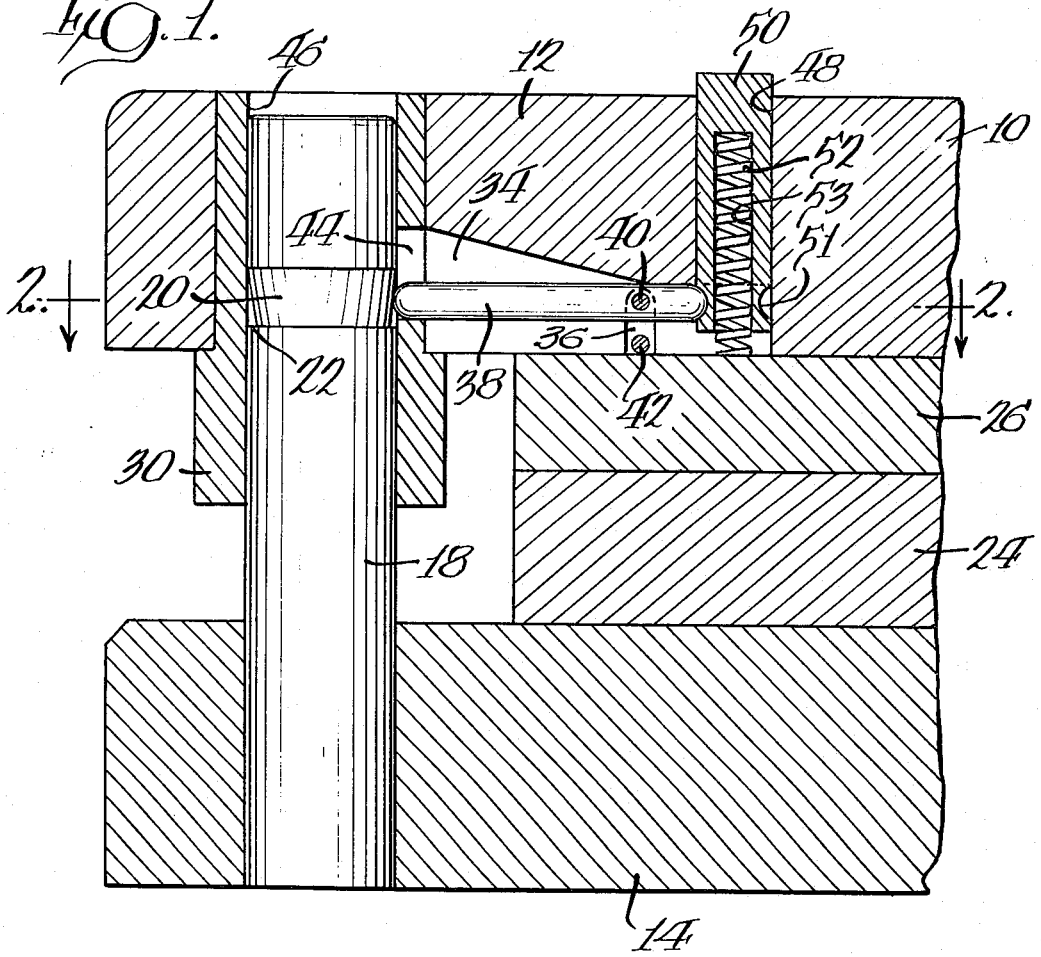
FIG. 1 is a fragmentary cross-sectional view in elevation of an automatic die safety lock for a metal stamping die shown in the locked position.
Figure 2:
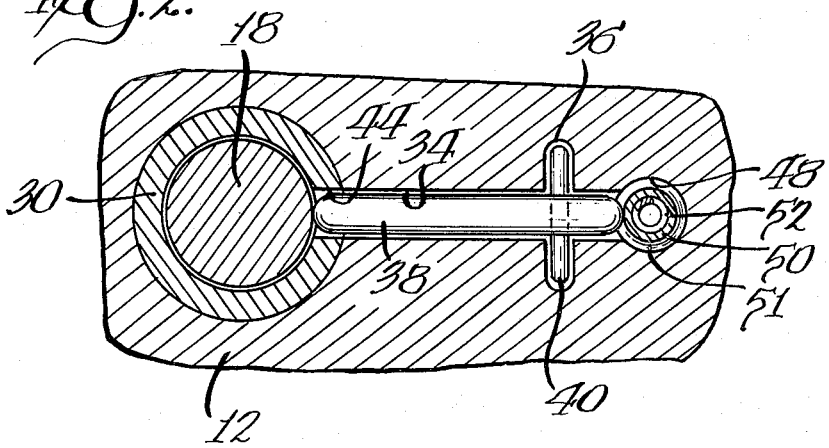
FIG. 2 is a cross-sectional view taken substantially along line 2—2 of FIG. 1 and illustrating a lockbar and a cross-bar in an upper die cavity.

Referring to FIGS. 1–4 of the drawings, a metal stamping die generally indicated as 10 for cutting and forming metal includes an upper die assembly 12 which is separable from a lower die assembly 14 when die 10 is operatively associated with a moveable platen 16 of a press. Lower die 14 has a vertical elongated leader pin 18 fixed therein. The leader pin 18 is slidably receivable in a vertical bushing 30 mounted in upper die 12. Insertion of leader pin 18 into bushing 30 aligns lower die 14 with upper die 12. Leader pin 18 is shaped to provide at its upper end an undercut portion 20 forming a camming or inclined locking surface 21. The camming surface 21 slopes downwardly and inwardly toward lower die 14 and terminates at shoulder 22. Lower die 14 also carries a lower portion 24 of a forming punch which matingly engages with upper portion 26 of a forming punch mounted in upper die 12.

Figure 3:
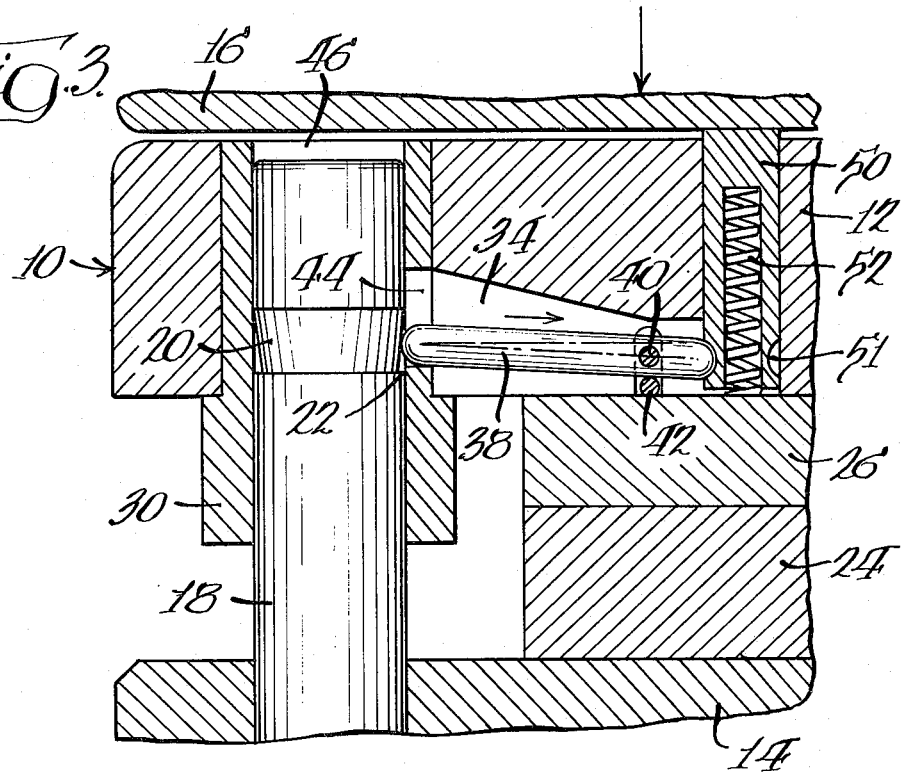
FIG. 3 is a fragmentary cross-sectional view in elevation similar to FIG. 1 but showing an automatic die safety lock in an intermediate position.
Figure 4:
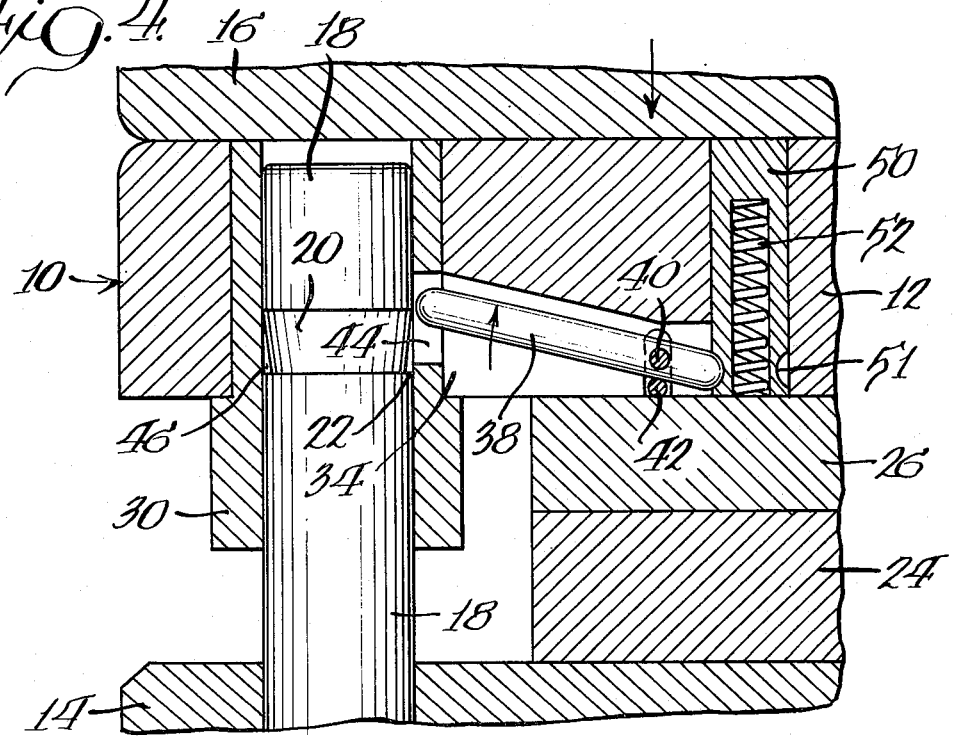
FIG. 4 is a fragmentary cross-sectional view in elevation similar to FIG. 3 but illustrating the automatic die safety lock in a released position.

Upper die 12 has formed therein an elongated cavity or slot 34 and a transverse slot 36 running perpendicular to and intersecting cavity 34. An elongated lockbar 38 lies within and is vertically moveable in cavity 34. A transversely extending cross pin 40 is connected to lockbar 38 and the ends thereof are slidably positioned in slot 36. A fixed pivot pin 42 is fixedly mounted beneath lockbar 38 preferably in vertical alignment with cross pin 40 as shown in FIG. 1. Vertically extending bushing 30 has a general horizontal opening or slot 44 formed in the bushing wall. The opening 44 faces the end of lockbar 38 and communicates with an inner, vertical, leader-pin receiving aperture 46 formed by bushing 30 so as to permit the left end of lockbar 38 to operatively engage the camming surface 21 defined by the undercut portion 20. Upper die 12 also has formed therein a vertically extending safety-pin receiving bore 48 which communicates with the right end of cavity 34. A safety pin 50 having a generally cylindrical configuration is positioned in vertical bore 48 for vertically slidable movement therein. Safety pin 50 has formed on the lower portion thereof a circumferentially extending groove 51 which is shaped complementarily to the curvature of the right end of lockbar 38 so as to provide means for operatively engaging the right end of lockbar 38. As shown in FIG. 1, the safety pin 50 is formed with an axially extending bore 53 for receiving therein a compression spring 52. When upper die 12 is not operatively associated with platen 16 and therefore out of press, spring 52 will urge safety pin 50 upward so that the upper end of safety pin 50 projects out of the upper side of upper die 12. When platen 16 is operatively associated with safety pin 50 and therefore in press, safety pin 50 is pushed downwardly by platen 16 as shown in FIGS. 3 and 4. Camming surface 21 is tapered inwardly toward lower die 14 so that any attempt to lift upper die 12 from lower die 14 will cause the left end of lockbar 38 to wedge against the surface 21 of leader pin 18. In the embodiment shown in FIGS. 1-4, cavity 34 is of sufficient vertical height to accommodate vertical movement of lockbar 38 so that the left end of lockbar 38 may retract slightly in the downward direction as shown in FIG. 3 when platen 16 engages safety pin 50 thereby eliminating the possibility of undesired wedging between lockbar 38 and surface 21 when die 10 is in press. Thus, cavity 34 is shaped to eliminate interference between lockbar 38 and undercut portion 20 during pivoting of lockbar 38 to a released position when die 10 is in press. It should also be noted that lockbar 38 does not rest on fixed pivot pin 42 as shown in FIG. 1 when die 10 is out of press. This embodiment permits assembly without any need to manually position lockbar 38.

In operation, safety pin 50 senses whether die 10 is in press. When out of press as shown in FIG. 1, spring 52 will move safety pin 50 upward so that the upper portion of safety pin 50 projects upwardly, out of upper die 12, to correspondingly cause lockbar 38 to be moved to its uppermost position so that the left end of lockbar 38 wedges against undercut portion 20, thereby locking upper die 12 and lower die 14 together. When platen 16 initially engages safety pin 50 as die 10 is being placed in press, platen 16 will move safety pin 50 downward to an intermediate position as shown in FIG. 3 to correspondingly move lockbar 38 to engage fixed pivot pin 42 causing the left end of lockbar 38 to retract slightly as shown and eliminate the possibility of interference between lockbar 38 and undercut portion 20. When in press, platen 16 moves safety pin 50 to its bottom-most position which correspondingly causes lockbar 38 to pivot in a clockwise direction about fixed pivot pin 42 as shown in FIG. 4, so that the left end of lockbar 38 swings away from undercut portion 20 thereby releasing upper die 12 and lower die 14 from their locked position and enable die 10 to operatively engage a workpiece. Should spring 52 fail when out of press, lockbar 38 will move to its intermediate position against fixed pivot pin 42 so that the left end of lockbar 38 remains engaged with camming surface 21 and thereby hold upper die 12 and lower die 14 in locking engagement with each other.

Figure 5:
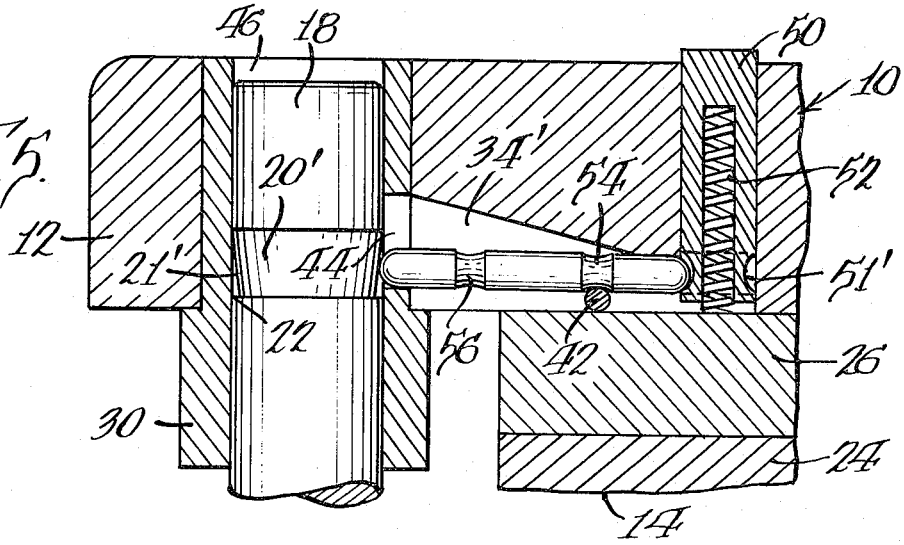
FIG. 5 is a fragmentary cross-sectional view in elevation of another embodiment of an automatic die safety lock for a metal stamping die shown in a locked position.
Figure 6:
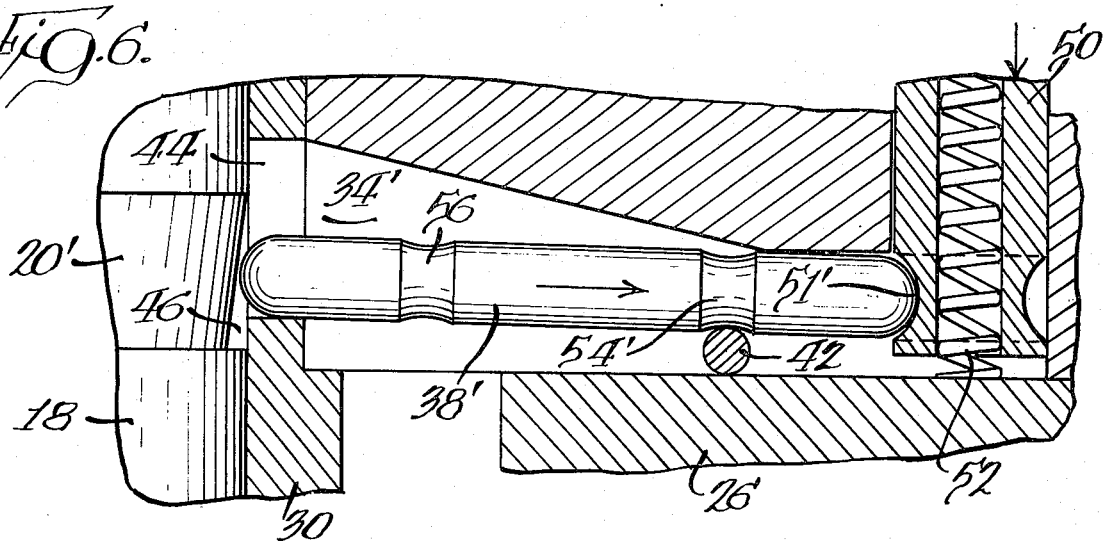
FIG. 6 is an enlarged view of a portion of FIG. 5, but showing the automatic die safety lock in an intermediate position.
Figure 7:
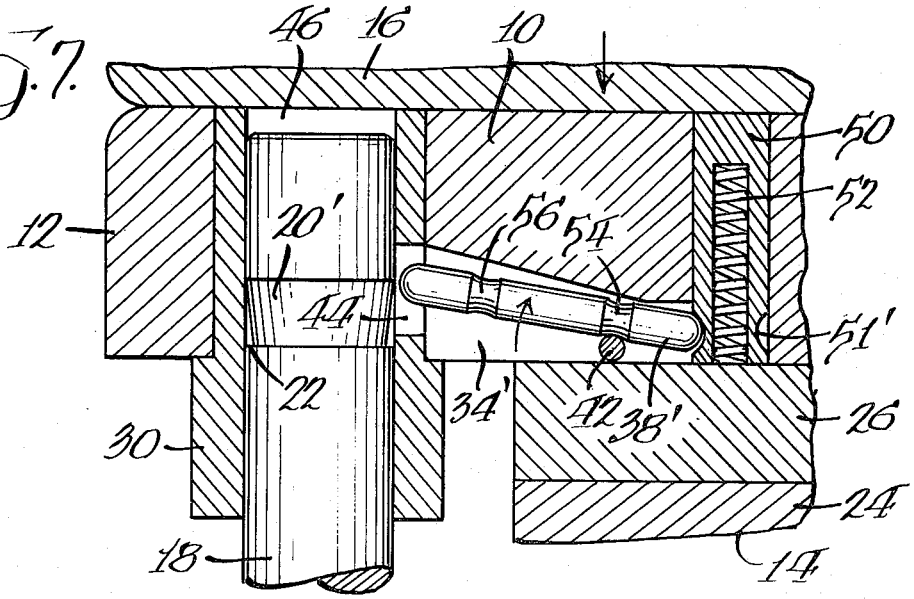
FIG. 7 is a cross-sectional view in elevation similar to FIG. 5, but illustrating an automatic die safety lock in a released position.

A second embodiment is shown in FIGS. 5–7 wherein the structure shown in substantially similar to that shown in FIGS. 1–4 except as herein specifically described and modified. Modified lockbar 38′ has a circular cross-section and has formed thereon a pair of axially spaced circumferentially extending grooves 54 and 56. The shape and height of cavity or slot 34′ is such that the right hand groove 54 is always resting on fixed pivot pin 42. Left hand groove 56 does not serve any function except to permit the lockbar 38′ to be turned end for end for easy assembly and construction of the locking mechanism. This embodiment does not include a cross pin 40 or transverse slot 36 as shown in FIGS. 1–4. Leader pin 18 is shaped to provide an undercut portion 20′ defining a camming surface 21′ such that the horizontal distance that the left end of lockbar 38′ projects into vertical bushing aperture 46, when die 10 is out of press, is approximately equal to twice the distance between the right end of lockbar 38′ and the innermost portion of a modified circumferentially extending radial groove 51′ formed in safety pin 50, to permit partial release of lockbar 38′ when platen 16 pushes safety pin 50 downwardly to an intermediate position and to avoid jamming. Thus, the curvature of the groove 51′ is greater than the curvature of the right end portion of lockbar 38′ so that the right end of lockbar 38′ is not entirely seated in the groove 51′ of safety pin 50 as shown in FIGS. 5–7.

In operation, safety pin 50 of the modified embodiment also senses whether die 10 is in press. When die 10 is out of press as shown in FIG. 5, spring 52 will move safety pin 50 in an upward direction so that the upper portion of safety pin 50 projects upwardly out of upper die 12, thereby correspondingly causing lockbar 38′ to pivot to a substantially horizontal position. In that position the left end of lockbar 38′ is engaged against the camming or locking surface 21′ formed by undercut portion 20′, thus locking upper die 12 and lower die 14 together. When platen 16 initially engages safety pin 50 as die 10 is being placed in press, platen 16 will push safety pin 50 downward to an intermediate position as shown in FIG. 6, causing lockbar 38′ to be partially released from camming or locking surface 21′. Platen 16 will push safety pin 50 downwardly to its bottommost position when die 10 is in press, to correspondingly cause lockbar 38′ to pivot in a clockwise position about pivot pin 42 so that the left end of lockbar 38′ swings away from the camming surface 21′, thereby releasing upper die 12 from locking engagement with lower die 14.

Those skilled in the art will appreciate that an automatic die safety lock for a metal stamping die has been shown and described which automatically locks an upper end lower die assembly together when the stamping die is out of press, and is operative to release the upper die assembly from locking engagement with the lower die assembly when the stamping die is in press.

Among the many advantages of my automatic die safety lock are:

1. The parts of the lock mechanism are substantially enclosed within the upper die to prevent adjustment, tampering or removal of the safety lock when the stamping die is in press.

2. When out of press, adjustment and removal of the safety lock may not be easily accomplished without the use of skilled tool-makers.

3. Provides operation safety, by preventing the press-operator from coming into contact with moving parts of the safety lock.

4. Does not interfere with the working area around the die, because the safety lock is located internally within the die.

5. Permits the lower die to be opened and sharpened out of press without substantially exposing the internal safety lock.

While preferred embodiments of the invention have been shown and described, it is to be understood that various modifications and substitutions may be made by those skilled in the art without departing from the novel spirit and scope of the invention.

I claim:

1. In a metal stamping die including upper and lower die assemblies and having a leader pin carried by the lower die assembly and slidably positioned in the upper die assembly, a locking mechanism for locking the upper and lower die assemblies together when the stamping die is out of press, and releasing the upper and lower die assemblies from locking engagement when the stamping die is in press, comprising:

means defining a cavity in the upper die assembly;

means defining a camming surface on the upper portion of the leader pin positioned in the upper die assembly;

a safety pin slidably disposed in a bore in the upper die assembly for sensing whether the die is in press, said safety pin projecting upwardly out of the upper die assembly when the die is out of press;

spring means associated with said safety pin normally urging said safety pin upwardly to the out of press position;

an elongated lockbar pivotally mounted in said cavity, one end of said lockbar being in engagement with said safety pin and the other end of said lockbar being engageable with said camming surface, said lockbar being movable to an in press position, an intermediate position and an out of press position; and pivot means for pivotally supporting said lockbar in said cavity.

2. The locking mechanism of claim 1 including:

a bushing in the upper die assembly which receives the upper end of the leader pin; and means defining an aperture in the wall of said bushing disposed adjacent said camming surface on the leader pin for receiving therethrough said other end of said lockbar.

3. The locking mechanism of claim 1 wherein:

said pivot means comprises a pivot pin positioned beneath said lockbar in fixed relationship with the upper die assembly.

4. The locking mechanism of claim 1 including:

means defining slot means disposed transversely of and intersecting said cavity means; and transverse pin means connected to said lockbar, the ends of said transverse pin means riding in said transverse slot means to permit up and down movement of said lockbar.

5. The locking mechanism of claim 1 wherein:

said safety pin includes means defining a curved groove in the lower end thereof and said lockbar has a rounded end for cooperative engagement with said curved groove in said safety pin.

6. The locking mechanism of claim 1 wherein:

said cavity is shaped to accommodate movement of the lockbar away from the pivot means to the out of press position and to permit pivotal movement of the lockbar away from the leader pin to an in press position.

7. The locking mechanism of claim 1 wherein:

said camming surface on said leader pin comprises an undercut portion defining an axially extending sloping surface which slopes radially inwardly toward the lower die assembly.

8. The locking mechanism of claim 1 wherein:

said one end of said lockbar is formed with a rounded end for cooperative pivotal engagement with a curved groove formed in the lower end of said safety pin, and said other end of said lockbar is formed with a rounded end for releasable locking engagement with said camming surface.

9. The locking mechanism of claim 1 wherein:

said lockbar includes means defining at least one circumferentially extending curved groove for receiving said pivot means, said lockbar being pivotally seated on said pivot means in the out of press position, the intermediate position and the in press position.

10. The locking mechanism of claim 9 wherein:

said cavity is shaped to accommodate pivotal movement of said lockbar away from the leader pin to an in press position.

11. The locking mechanism of claim 1 wherein:

said lockbar comprises a cylindrical rod including a pair of spaced radial grooves spaced equidistantly from each end of said lockbar, whereby during assembly of the mechanism either end of said lockbar may be placed in engagement with said safety pin and so that the radial groove nearest the safety pin may receive said pivot means.

12. The locking mechanism of claim 11 wherein:

said lockbar includes a first rounded end portion for cooperative locking and releasing engagement with said camming surface and a second rounded end portion for cooperative pivotal engagement with a curved groove formed on the lower end of said safety pin.

* * * * *